United States Patent [19]

Yamamoto et al.

[11] Patent Number: 4,885,057

[45] Date of Patent: Dec. 5, 1989

[54] METHOD FOR TREATING SYNTHETIC PULP PARTICLES, AND PULP PARTICLES COMPOSED OF SYNTHETIC POLYMER

[75] Inventors: Michio Yamamoto; Tsutomu Kiriyama; Noriaki Sasaki; Yoshitaka Sakamoto; Kenji Ishimaru, all of Iwakuni, Japan

[73] Assignee: Teijin Limited, Osaka, Japan

[21] Appl. No.: 7,964

[22] Filed: Jan. 28, 1987

[30] Foreign Application Priority Data

Jan. 30, 1986 [JP] Japan ..... 61-16704
Feb. 26, 1986 [JP] Japan ..... 61-38978

[51] Int. Cl.[4] ..... D21D 5/00
[52] U.S. Cl. ..... 162/9; 162/157.3
[58] Field of Search ..... 162/157.3, 182, 157.5, 162/9

[56] References Cited

U.S. PATENT DOCUMENTS 2,999,788 9/1961 Morgan ..... 162/146
4,013,751 3/1977 Davis et al. ..... 162/157.5 X
4,049,492 9/1977 Lare ..... 162/157.5 X
4,519,873 5/1985 Amano et al. ..... 162/157.3 X
4,724,046 2/1988 Yamamoto et al. ..... 162/157.2 X

OTHER PUBLICATIONS

European Search Report Appln. No. EP 87 10 0777, with Documents of Interest Attached (4 patents).

*Primary Examiner*—Peter Chin
*Assistant Examiner*—Thi Dang
*Attorney, Agent, or Firm*—Burgess, Ryan & Wayne

[57] ABSTRACT

A method for treating synthetic pulp particles, which includes treating a slurry of synthetic pulp particles having a Schopper-Riegler freeness of more than 30°SR by a concentration provided with a rotary filter bed to lower the freeness not more than 30°SR, water-washing the synthetic pulp particles in the state where the freeness is not more than 30°SR, and dispersing the synthetic pulp particles in water to restore the freeness to more than 30°SR.

4 Claims, 2 Drawing Sheets

METHOD FOR TREATING SYNTHETIC PULP PARTICLES, AND PULP PARTICLES COMPOSED OF SYNTHETIC POLYMER

BACKGROUND OF THE INVENTION (1) Field of the Invention

The present invention relates to a method for treating synthetic pulp particles, and pulp particles composed of a synthetic polymer.

(2) Description of the Related Art

Pulp particles composed of a synthetic polymer such as a polyamide or polyester have attracted attention as a material of an electrically insulating paper, a friction material or a heat-resistant flame-proof article, because of their excellent electrical insulating property, heat resistance, and other properties. It is considered that pulp particles composed of a wholly aromatic polyamide such as poly(metaphenylene isophthalamide) or poly(paraphenylene terephthalamide) have various excellent characteristics and an especially high utility, but, for example, the synthetic pulp particles disclosed in Japanese Examined Patent Publication No. 35-11851 are defective in that when a paper is prepared from these synthetic pulp particles according to the wet method, since the paper-forming property is poor, it is difficult to obtain a paper having a uniform formation, and when the synthetic pulp particles are formed in an electrically insulating article, the insulating property is unsatisfactory.

As means for eliminating these defects, there can be considered a method in which pulp particles are beaten by a beater or the like to the freeness. The relationship between the freeness and the physical properties of the formed paper is illustrated, for example, in "Pulp and Paper", written by Katsumoto Atsugi, and the relationship between the freeness and the insulation breakdown voltage (BDV) is illustrated in "Electrically Insulating Paper", written by Yuichiro Take et al, and it is suggested that a pulp having a high Schopper-Riegler freeness gives a formed paper having good physical properties. It is confirmed that this also holds good with respect to synthetic pulp particles, and in order to obtain good physical properties, synthetic pulp particles having a Schopper-Riegler freeness of at least 30° SR are preferably used. However, the handling property of pulp particles having such a freeness is bad. For example, when pulp particles are prepared by introducing a solution of a synthetic polymer into a coagulation bath, if pulp particles giving a paper having good physical properties are formed, the freeness inhibits the operation of separating the formed pulp particles from the slurry or the operation of washing and purifying the separated pulp particles, resulting in a reduction of the productivity.

As is apparent from the foregoing description, synthetic pulp particles have such contradictory properties that, if it is intended to obtain pulp particles giving a paper having good properties, the handling property is degraded at the steps of forming and treating the pulp particles, and this is a serious problem in the industrial production of good pulp particles.

SUMMARY OF THE INVENTION

It is a primary object of the present invention to provide a treating method in which the above-mentioned contradictory properties of synthetic pulp particles can be overcome and pulp particles having an improved handling property at the steps of forming and water-washing pulp particles and giving a paper having good physical properties can be obtained.

The inventors carried out research with a view to attaining this object, and as the result, found that a treating method in which pulp particles are treated so that, at the paper-forming step, the freeness is reduced to obtain a paper having intended properties and the pulp particles show a freeness at the steps prior to the paper-forming step to facilitate handling is effective for attaining the above-mentioned object. The inventors carried out further research based on this finding, and thus completed the present invention.

More specifically, in accordance with the present invention, there is provided a method for treating synthetic pulp particles, which comprises treating a slurry of synthetic pulp particles having a Schopper-Riegler freeness of more than 30° SR by a concentrator provided with a rotary filter bed to lower the freeness to not more than 30° SR, water-washing the synthetic pulp particles in the state where the freeness is not more than 30° SR, and dispersing the synthetic pulp particles in water to restore the freeness to more than 30° SR.

DESCRIPTION OF THE PREFERRED EMBODIMENTS

Figure 1:
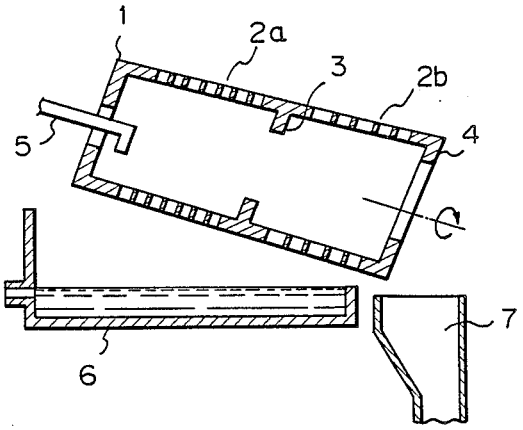
FIG. 1 is a simplified sectional view illustrating an example of the concentrator provided with a rotary filter bed, which is used in carrying out the treating method of the present invention.

The synthetic pulp particles to be treated according to the method of the present invention are preferably synthetic pulp particles (sometimes called "fibrids") obtained according to the so-called precipitation method, in which a solution of a synthetic polymer is introduced into a coagulation bath to which a shearing force is applied to precipitate fibrils (see, for example, Japanese Examined Patent Publications No. 35-11851, No. 37-5732 and No. 40-9044).

Various synthetic polymers such as polyamides, polyamide-imides, polyesters, polycarbonates, and polyethers may be used as the synthetic polymer constituting the synthetic pulp particles. From the industrial viewpoint, preferably wholly aromatic polyamides such as poly(metaphenylene isophthalamide), poly(paraphenylene terephthalamide) and poly(paraphenylene/3,4'-diphenylether terephthalamide) are used.

Any solvent capable of dissolving the synthetic polymer can be used as the solvent, without limitation. In the case of a wholly aromatic polyamide, an amide type solvent such as N,N-dimethylacetamide or N-methyl-2-pyrrolidone can be used according to the kind of polyamide. Since the viscosity of the solution has a significant influence on the shape of the obtained pulp particles, the viscosity should be practically limited within a certain range. It is generally sufficient if the viscosity of the solution is about 10 to about 500 poise. The viscosity of the solution can be adjusted by controlling the temperature. A liquid which is a non-solvent for the synthetic polymer and is compatible with the solvent in the polymer solution is used as the precipitating agent constituting the coagulation bath. From the industrial viewpoint, preferably a mixture of the solvent used for the polymer solution and a non-solvent (for example, water) is used.

As the apparatus for precipitating the pulp particles, there can be used, for example, a tank provided with a high-speed stirrer in a coagulation bath, as disclosed in Japanese Examined Patent Publication No. 35-11851, and a precipitation apparatus as disclosed in Japanese Examined Patent Publication No. 37-5732. Among various precipitating apparatuses, a tube stirring type continuous precipitating apparatus provided with a rotor, as disclosed in Japanese Examined Patent Publication No. 59-47695, is preferred.

In carrying out the method of the present invention, pulp particles having a relatively high freeness (°SR), that is, a freeness of more than 30° SR, are formed by appropriately adjusting parameters such as the shearing force, temperature, coagulation bath, solution concentration, and coagulating liquid/solution ratio at the precipitating step.

According to the method of the present invention, the so-obtained slurry of the synthetic pulp particles having a freeness of more than 30° SR is subjected to the concentration treatment by a concentrator provided with a rotary filter bed.

A concentrator of the type in which the lower portion of a filter bed, that is, the filtration surface, is always immersed in a bath of the discharged filtrate, as in an ordinary rotary thickener, is not preferred, but a concentrator of the type in which pulp particles are placed on a filter bed, peeled from th filter bed, and moved to a different position by rotation of the filter bed, dropped and placed on another part of the filter bed, and peeled from the filter bed and moved, and these procedures are repeated, is desired.

According to the method of the present invention, the freeness of the synthetic pulp particles is reduced to not more than 30° SR by this concentrator provided with a rotary filter bed, and the drainage rate is improved. This means that, at the above-mentioned concentration step, a change of the shape is caused in the pulp particles. For example, the pulp particles obtained by the precipitation method have a leaflet-like shape, but it is construed that the pulp particles are temporarily rounded by the above-mentioned treatment.

FIG. 1 is a partially simplified sectional view illustrating an example of the concentrator provided with a rotary filter bed as described above. In FIG. 1, reference numeral 1 represents a rotary cylinder, and the majority of the peripheral surface of the rotary cylinder 1 constitutes filtration surfaces 2*a* and 2*b* formed of a wire and/or a perforated plate. Reference numeral 3 represents a weir arranged within the rotary cylinder, and reference numeral 4 represents a weir arranged on the exit side end of the rotary cylinder. Reference numeral 5 represents a slurry feed pipe arranged on the inlet side of the rotary cylinder. Reference numeral 6 represents a filtrate-receiving tank and a reference numeral 7 represents a hopper for receiving a concentrated slurry. In a concentrator suitable for carrying out the method of the present invention, the rotary cylinder 1 is inclined from the slurry introduction side to the discharge side and the rotary cylinder 1 is arranged so that the filter bed (the lower filtration surface) of the rotary cylinder 1 is not immersed in the filtrate in the receiving tank 6.

Figure 2:
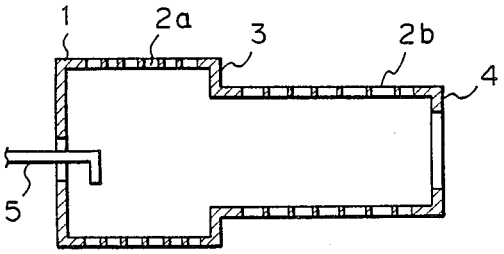
FIGS. 2 and 3 are simplified sectional views illustrating other examples of the rotary cylinder constituting the concentrator.

FIG. 2 is a simplified sectional view illustrating another embodiment of the rotary cylinder 1, in which the inner diameter on the slurry introduction side is increased and the inner diameter of the discharge side is reduced so that a step is formed within the cylinder. In the rotary cylinder 1, this step portion forms a weir 3.

Figure 3:
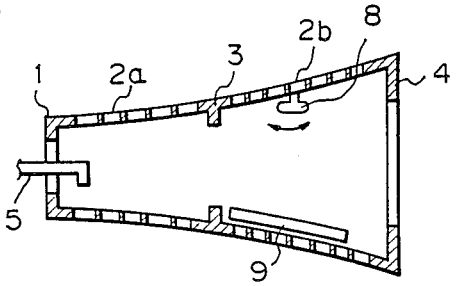

FIG. 3 is a simplified sectional view illustrating still another embodiment of the rotary cylinder, which has a tapered cylindrical shape where the inner diameter is gradually changed from the slurry introduction side to the discharge side. In the rotary cylinder, a scraper plate 9 is disposed in the lower portion of the cylinder to scrape up the slurry adhering to the filter bed surface, and a shaking dropping device 8 is arranged in the upper portion of the cylinder to impart vibrations to the filter bed surface (ceiling portion) to drop the slurry. In this tapered cylinder, even if the central axis is horizontally arranged, the filter bed is inclined toward the discharge side, and therefore, the method of the present invention can be carried out.

In the above-mentioned concentrator, the slurry supplied through the feed pipe 5 is moved in the rotary cylinder 1 toward the discharge side while being filtered by the filter bed of the rotary cylinder 1. Although the slurry is stopped by the weir 3, the slurry is scraped up by the rotary movement in the state where the slurry is placed on the filter bed surface, and then the slurry is peeled from the filter bed surface and is dropped and beaten on the lower filter bed surface. The slurry which has ridden across the weir 3 is similarly treated at another position of the filter bed. Thus, the slurry is gradually dehydrated and concentrated.

If the slurry is concentrated to some extent, it adheres in the sludge-like state to the filter bed and is naturally dropped with rotation of the rotary cylinder. However, in order to smoothly repeat the scraping and dropping operations while the slurry is moved in the rotary cylinder, preferably, as shown in FIG. 3, a scraper plate 8 extending in the axial direction in the lower portion of the cylinder is disposed or a shaking dropping device 9 is disposed in the upper portion of the rotary cylinder. Preferably, this rotary filter bed is rotated at a rate of 10 to 100 rotations per minute. If the rotation speed is too low, the effect is insufficient, and if the rotation speed is too high, the operation becomes difficult.

The filter bed must be disposed so that the filter bed is not immersed in the filtrate at all. If the concentrated slurry is immersed in the filtrate, undesirable influences are imposed on the improvement of the filtering property of the slurry, and the freeness is not substantially changed during the concentration treatment.

According to the conventional technique, a slurry of a granular product is ordinarily concentrated by filtration. For example, there can be mentioned a method using a filter bed formed of a filter cloth and a method using a rotary thickener. In each of these methods, concentration is effected so that the shape of particles in the slurry is not damaged, but even if concentration is carried out by these methods, the freeness is hardly changed and the intended object of the present invention cannot be attained.

In the method of the present invention, the freeness is reduced to not more than 30° SR by the above-mentioned concentration treatment, and the obtained synthetic pulp particles having an improved drainage rate show a good draining property and an improved handling property.

According to the method of the present invention, such synthetic particles are water-washed and purified in the state where the freeness is not more than 30° SR.

For the water-washing treatment, there is effectively adopted a method previously proposed by us, in which pulp particles are compressed and washing water is forcibly circulated through a layer of the compressed pulp particles to effect substitution washing (see the specification of European Patent Application No. 85103748.1).

Synthetic pulp particles having a freeness of more than 30° SR have a poor drainage, and it is difficult to effect the above-mentioned substitution washing. Various problems must be solved for increasing the washing efficiency while adopting this water washing method. However, the synthetic pulp particles in which the freeness is reduced to not more than 30° SR by the above-mentioned concentration treatment can be drained in a short time by compression, and therefore, water washing can be accomplished efficiently with a relatively small amount of washing water.

In this substitution washing, preferably, as previously proposed, the synthetic pulp particles are once compressed and drained to form a plate-like or disk-like cake of the assembly of the pulp particles, the cake is mechanically broken to form granules, the granules are compressed again, and water is forcibly circulated in the compressed state to effect substitution washing.

Surprisingly, it was found that, if the so water-washed and purified pulp particles are dispersed in water again, the freeness is restored to more than 30° SR and a slurry of synthetic pulp particles having a good paper-forming property can be obtained. Dispersion of the synthetic pulp particles in water can be accomplished by using an ordinary stirrer, and a special means is not necessary.

It is considered that although the shape of the pulp particles is temporarily changed by the above-mentioned concentration treatment, the original shape can be easily restored by dispersing the pulp particles in water again.

This property is not observed when the freeness of pulp particles is adjusted by known means such as beating or filtration.

The pulp particles in which the freeness is returned to at least 30° SR are subjected to the paper-forming operation according to a customary method using, for example, a Fourdrinier paper machine, whereby a paper-like sheet having a good formation and excellent physical properties such as strength, elongation, and electrically insulating property can be obtained.

In accordance with a second aspect of the present invention, there are provided pulp particles of a synthetic polymer obtained by introducing a solution of a synthetic polymer into a coagulation bath to which a high shearing force is applied, to effect coagulation and fibrilation, wherein (a) the Schopper-Riegler freeness of the pulp particles is 20° to 30° SR and (b) the Schopper-Riegler freeness is restored to 40° to 85° SR only by dispersing the pulp particles in water.

An apparatus in which a solution of a synthetic polymer is introduced in a coagulation bath to which a high shearing force is applied, and the synthetic polymer is precipitated in the form of a fine leaflet or fibril, may be used as the apparatus (precipitation apparatus) for forming pulp particles. For example, as pointed out hereinbefore, there may be used an apparatus provided with a high-speed stirrer, disclosed in Japanese Examined Patent Publication No. 35-11851, and a tube type precipitation apparatus disclosed in Japanese Examined Patent Publication No. 37-5732. However, a tubular path stirring type precipitation apparatus comprising a stator and a rotor in combination, disclosed in Japanese Examined Patent Publication No. 59-47695, is especially preferred.

The so-obtained pulp particles are in the form of a slurry, and the Schopper-Riegler freeness of the pulp particles is about 50° to about 80° SR.

The pulp particles of the present invention are obtained by introducing this slurry into a rotary filter bed comprising as the main member an inclined cylinder having a peripheral wall formed of a wire or perforated plate, peeling and moving the pulp particles from the filter bed surface with rotation of the filter bed, depositing the pulp particles on other position of the filter bed surface, peeling the pulp particles from the filter bed surface and repeating these operations to effect concentration. In the so-obtained pulp particles of the present invention, the Schopper-Riegler freeness is lowered to 20° to 30° SR.

A concentration apparatus in which the filter bed surface is always immersed in a bath of the discharged filtrate, such as so-called rotary thickener, is ordinarily used for concentration of a slurry, but such an apparatus is not preferred because the freeness is hardly changed.

It is presumed that the Schopper-Riegler freeness is lowered to 20° to 30° SR by the concentration treatment using the above-mentioned rotary filter bed because, by the repetition of peeling, movement and deposition in the slurry of th pulp particles is concentrated, the pulp particles in the form of a leaflet are rounded or converted to a fibril, or another change of shape is caused in the pulp particles.

The so-obtained pulp particles of the present invention have a peculiar property such that, when they are dispersed in water again, the Schopper-Riegler freeness is restored to 40° to 85° SR. It is presumed that this specific property is due to the fact that the shape of the pulp particles is returned to the shape before the concentration treatment only by dispersing the pulp particles in water again.

Although the pulp particles of the present invention have a Schopper-Riegler freeness of 20° to 30° SR, the Schopper-Riegler freeness is returned to 40° to 85° SR only by dispersing the pulp particles in water again. Accordingly, the re-dispersed pulp particles are comparable to the pulp particles just after the precipitation in the paper-forming property and the physical properties of the formed paper.

Figure 4:
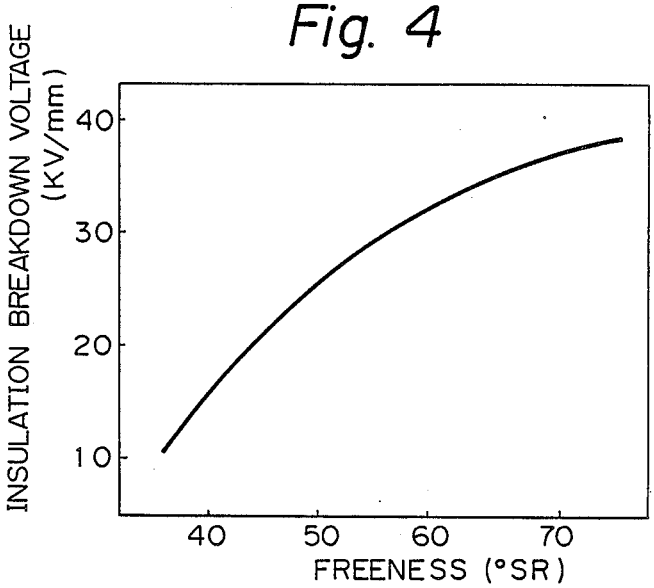
FIG. 4 is a graph illustrating the relationship between the freeness of the pulp particles and the insulation breakdown voltage of a paper formed from the pulp particles; and, FIG. 5 is a graph illustrating the relationship between the freeness of the pulp particles and the specific filtration resistance.

The relationship between the Schopper-Riegler freeness (abscissa) of pulp particles (slurry) and the insulation breakdown voltage (ordinate) of a paper formed from the pulp particles and fibers, observed with respect to pulp particles of poly(m-phenylene isophthalamide), is shown in FIG. 4. The case where pulp particles just after the precipitation are used and the case where the Schopper-Riegler freeness is once lowered to 20° to 30° SR and the Schopper-Riegler freeness is restored by re-dispersion after water-washing are expressed by one relation line, and no substantial difference is observed. This means that even if the Schopper-Riegler freeness is once lowered to 30° SR or less by the above-mentioned concentration treatment, the paper-forming property is not adversely influenced. However, if the Schopper-Riegler freeness is lowered below 20° SR, it often happens that the Schopper-Riegler freeness is not returned to 40° to 85° SR only by re-dispersion in water. Accordingly, reduction of the Schopper-Riegler freeness below 20° SR is not preferred.

The Schopper-Riegler freeness of the pulp particles before the re-dispersion is in the range of from 20 to 30° SR, and the pulp particles having a Schopper-Riegler freeness included within this range are characterized in that the handling property is excellent and water washing and other treatments can be performed very easily.

Figure 5:
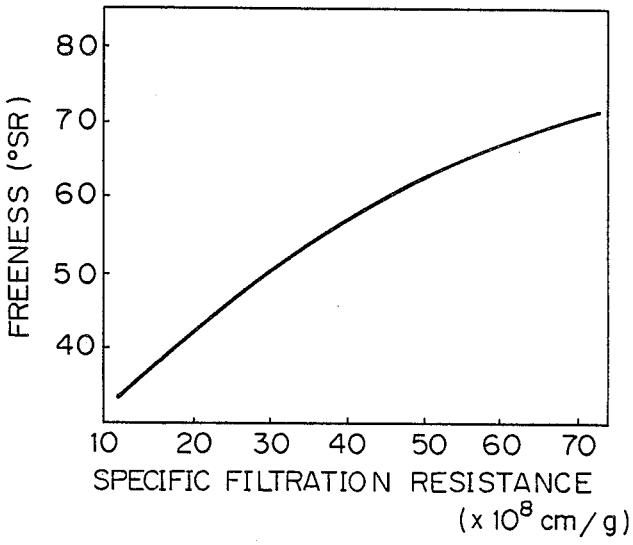

FIG. 5 illustrates the relationship between the Schopper freeness (ordinate) and the specific filtration resistance (abscissa), and the filtration speed is directly determined by the specific filtration resistance according to the following formula:

$$u = \frac{mgc}{\alpha\rho c\mu} \cdot \frac{dp}{dl}$$

wherein u stands for the amount of the washing liquid per unit filtration area (i.e., filtration speed), m stands for the mass, gc stands for the coefficient for conversion to the gravity, $\alpha$ stands for the specific filtration resistance, $\rho c$ stands for the wet density, $\mu$ stands for the viscosity of the filtrate, p stands for the pressure and l stands for the thickness of the cake.

Accordingly, in the present invention, at the precipitation step (the step of formation of pulp particles), pulp particles having a low hydrating property, which are preferred in view of the physical properties and paper-forming property but are difficult to handle, are formed and the pulp particles are subjected to the concentration treatment to change them to pulp particles having a high hydrating property, which are easy to handle. After these pulp particles are subjected to various treatments such as water washing, the pulp particles are dispersed in water to restore them to pulp particles having a low hydrating property and excellent physical properties and paper-forming property. As the result, a good handling property can be maintained throughout the preparation and treatment of pulp particles and the paper-forming operation, and a paper having improved properties can be obtained.

In order to improve the physical properties of a paper product, beating of a pulp is ordinarily carried out. As the beating degree of the pulp is increased, the hydrating property of the pulp is gradually reduced, and the hydrating property cannot be reduced below a certain level. The physical properties of the paper product are improved with the reduction of the hydrating property, and the improvement reaches the ceiling and the physical properties are degraded if the dehydrating property is further reduced. Accordingly, a pulp having such a high freeness that it is as not dispersible only by dispersion to such a degree as for measurement of the freeness can be formed according to a certain method, for example, filtration and compression, and the freeness can be increased by beating this pulp. However, in the case of this pulp, the freeness cannot be increased by dispersion or the like. As another method, there can be mentioned a method in which the dehydrating property is improved by removing the fine pulp particles by filtration, but in the case of the resulting pulp, the original freeness cannot be restored only by dispersion.

According to the above-mentioned method of the present invention, the handling property of pulp particles at the step of separating the pulp particles from the slurry and the step of washing and purifying the pulp particles is highly improved, and these steps can be performed efficiently. Furthermore, in pulp particles finally dispersed in water again, the freeness is returned to a level substantially equal to the freeness of the as-prepared pulp particles. Accordingly, the obtained paper product has a good formation and excellent mechanical properties and electrically insulating property.

Therefore, the method of the present invention is very valuable from the industrial viewpoint because pulp particles which are cheap in comparison with the product quality can be prepared.

Of course, when the pulp having the reduced freeness is laminated and compressed, little compressive adhesion is caused. This property is very advantageous when washing is carried out while adopting a method disclosed in the specification of European Patent Application No. 85103748.1 or the like. For example, even in the case where the dispersion is insufficient after purification of a synthetic pulp, and dots are left in the formed paper because of the presence of undispersed pulp particles when the method disclosed in European Patent Application No. 85103748.1 is adopted without using the method of the present invention, if the method of the present invention is adopted in combination with the above-mentioned washing method, the insufficient dispersion is greatly moderated and a paper having a good formation can be obtained.

The pulp particles of the present invention show a very good handling property at steps such as separation and water washing, and the paper-forming property and the physical properties of the formed paper are highly improved. These advantages cannot be attained in the conventional pulp particles, and the pulp particles of the present invention have a great industrial utility.

A good paper product is obtained by subjecting the pulp particles of the present invention alone or in combination with short fibers or an inorganic substance to the paper-forming operation. The obtained paper product can be widely used as an electrically insulating material, a honeycomb material, a friction material, a heat-resistant flame-proof material, and the like, in various fields.

The present invention will now be described in detail with reference to the following examples and comparative examples.

Note, in the examples, $\eta$inh is the inherent viscosity as measured with respect to a solution of the polymer in N-methyl-2-pyrrolidone, and the freeness (°SR) is determined according to the Schopper-Riegler method specified in JIS.

EXAMPLE 1

Poly(metaphenylene isophthalamide) was prepared according to the interfacial polymerization process disclosed in Japanese Examined Patent Publication No. 47-10863, corresponding to U.S. Pat. No. 3,640,970. The $\eta$inh of the obtained polymer was 1.31.

The polymer was dissolved in N-methyl-2-pyrrolidone to form a solution having a polymer concentration of 12.5%. Separately, an aqueous solution containing 30% of N-methyl-2-pyrrolidone was prepared and used as a precipitating agent constituting the coagulation bath.

By using the above-mentioned polymer solution and precipitating agent, pulp particles were prepared in a pulp path stirring type continuous precipitation apparatus provided with a stator and a rotor, as disclosed in Japanese Examined Patent Publication No. 59-47695. The amounts supplied of the polymer solution and precipitation agent were 60 parts and 1800 parts, respectively, and the rotor was run at a speed of 9000 rpm.

The obtained slurry of the pulp particles was simply filtered and the water content in the obtained cake of the pulp particles was measured, and the freeness of the pulp cake was determined. The freeness was 70° SR.

The slurry of the pulp particles was concentrated by using the apparatus shown in FIG. 1 (the maximum inner diameter of the apparatus was 350 mm, the filtration area was 0.72 $mm^2$, and the hold-up was 50 l) at a rotation number of 23 rpm.

The freeness of the pulp particles after the concentration treatment was 23° SR.

The pulp particles were compressed in a compression apparatus disclosed inthe specification of European Patent Application No. 85103748.1 (the inner diameter was 100 mm), the obtained disc-shaped cake was broken by a household electric mixer and compressed again by the above-mentioned compression apparatus, and water was forcibly circulated through the pulp particles in the compressed state to effect substitution washing. The compression and washing was carried out very efficiently.

The pulp particles were stirred together with water by a household electric mixer under the application of a voltage of 70 V for 5 minutes to disperse the pulp particles in water.

The freeness of the obtained pulp particles was 70° SR.

The pulp particles were mixed with short fibers of poly(metaphenylene isophthalamide) having a fineness of 2 denier and a length of 6 mm at a pulp/fiber ratio of 6/4, and the mixture was formed into a paper-like sheet. The strength, elongation, and BDV (insulation breakdown voltage) were measured.

The obtained results and other related data are shown in Table 1.

TABLE 1

| | Just After Precipitation | After Re-dispersion |
|---|---|---|
| Results (%) of Sieving of Pulp Particles (by JIS) | | |
| smaller than 150 mesh | 7.7 | 7.7 |
| 150 to 80 mesh | 9.3 | 9.4 |
| 80 to 48 mesh | 21.3 | 21.7 |
| 48 to 24 mesh | 38.5 | 37.8 |
| larger than 24 mesh | 23.2 | 23.4 |
| Formed Paper-like Product | | |
| BDV (KV/mm) | 38.4 | 37.8 |
| Strength ($Kg/mm^2$) | 8.9 | 9.1 |
| Elongation (%) | 23.8 | 24.0 |

EXAMPLES 2 THROUGH 4

Pulp particles of poly(metaphenylene isophthalamide) were prepared in the same manner as described in Example 1, and the freeness of the pulp particles was changed by changing the rotation number in the same concentration apparatus as used in Example 1.

In the same manner as described in Example 1, the pulp particles were dispersed in water and the freeness was measured, and water washing was carried out and a paper was formed in the same manner as described in Example 1, and the physical properties of the formed paper were determined.

The obtained results are shown in Table 2. No substantial change other than the change of the freeness was caused by the change of the rotation number.

Note, the time required for compressing the pulp particles obtained in each of Examples 2 through 4 to the water/pulp ratio of 4/1 by using the same apparatus as used in Example 1 was 4.0 minutes.

TABLE 2

| | Example 2 | Example 3 | Example 4 |
|---|---|---|---|
| Rotation Number (rpm) | 15 | 35 | 45 |
| Freeness (°SR) just after Precipitation | 69.5 | 65.7 | 70.5 |
| Freeness (°SR) after Concentration | 24.8 | 22.8 | 21.6 |
| Freeness (°SR) after Re-dispersion | 67.5 | 67.2 | 69.8 |
| Formed Paper: | | | |
| BDV (KV/mm) | 36.9 | 35.3 | 35.8 |
| Strength ($Kg/mm^2$) | 8.05 | 7.66 | 8.46 |
| Elongation (%) | 23.5 | 22.3 | 24.0 |

EXAMPLES 5 THROUGH 8

Poly(metaphenylene isophthalamide) having $\eta$inh of 1.35 was prepared in the same manner as described in Example 1, and pulp particles were prepared from this polymer in the same manner as described in Example 1. The freeness of the pulp particles was 65.7° SR.

The freeness was lowered in the same manner as described in Example 1 except that the hold-up of the rotary filter bed was changed. The obtained results are shown in Table 3. No substantial change other than minor changes was caused by the change of the hold-up.

TABLE 3

| | Example 5 | Example 6 | Example 7 | Example 8 |
|---|---|---|---|---|
| Hold-up (l) | 45 | 50 | 55 | 60 |
| Freeness (°SR) just after precipitation | 65.7 | 65.7 | 65.7 | 65.7 |
| Freeness (°SR) after Concentration | 24.6 | 23.8 | 23.5 | 24.1 |
| Freeness (°SR) after Re-dispersion | 65.7 | 65.0 | 66.0 | 65.7 |
| Properties of Formed Paper: | | | | |
| BDV (KV/mm) | 37.6 | 37.6 | 36.3 | 37.5 |
| Strength ($Kg/mm^2$) | 7.13 | 7.67 | 7.77 | 7.85 |
| Elongation (%) | 22.9 | 23.0 | 22.5 | 23.3 |

EXAMPLE 9

Poly(metaphenylene isophthalamide) was obtained according to the interfacial polymerization process disclosed in Japanese Examined Patent Publication No. 47-10863, corresponding to U.S. Pat. No. 3,640,790. The inherent viscosity $\eta$inh of the polymer was 1.32. The polymer was dissolved in N-methyl-2-pyrrolidone to form a solution having a polymer concentration of 12.5%. Separately, an aqueous solution containing 30% of N-methyl-2-pyrrolidone was prepared and used as the coagulating solution. Pulp particles were prepared by using the polymer solution and coagulating solution in the same manner as described in Example 1. The freeness of the obtained pulp particles was 67.5° SR.

The obtained pulp particles were subjected to the concentration treatment by using a rotary filter bed shown in FIG. 1 and having a maximum diameter of 350 mm, a filtration area of 0.72 $m^2$ and a hold-up of 50 l. The freeness after the treatment was 23.5° SR.

The slurry of the pulp particles was compressed by the apparatus disclosed in the specification of European Patent Application No. 85103748.1, which has an inner diameter of 250 mm, to form a solid disc-shaped cake. The cake was broken by a clasher supplied by Horai Tekko and the resulting particles were subjected to the substitution washing by using the apparatus disclosed in the specification of European Patent Application No. 85103748.1. The water washing efficiency was very good and N-methyl-2-pyrrolidone was not substantially detected in the water-washed pulp particles. The water-washed pulp particles were dispersed in water by a high-speed disintegrator supplied by Aikawa Tekko. The freeness of the dispersed particles was 67.5° SR. The sieving results just after precipitation (pulping) were the same as the sieving results after the dispersion. The pulp particles were mixed with short fibers of the same polymer having a fineness of 2 de and a length of 6 mm and the mixture was formed into a paper by using a Fourdrinier paper machine, followed by hot pressing. The obtained paper had a strength of 9.5 Kg/$mm^2$ in the longitudinal direction and 4.0 Kg/$mm^2$ in the lateral direction, an elongation of 14.5% in the longitudinal direction and 11.0% in the lateral direction, and an insulation breakdown voltage of 35.6 KV/mm.

EXAMPLE 10 AND COMPARATIVE EXAMPLES 1 THROUGH 3

The time required for compressing 40 g (actual amount) of the pulp particles used in Example 2 to the water/pulp ratio of 4/1 by using the apparatus disclosed in the specification of European Patent Application No. 85103748.1 and having an inner diameter of 100 mm was 4.0 minutes (Example 10).

The freenes of pulp particles obtained by treating the same pulp slurry by a rotary thickener supplied by Ishigaki Kiko and the time required for compressing the resulting pulp particles to the same water/pulp ratio as described above by using the apparatus described in Example 1 were measured (Comparative Examples 1 through 3). The obtained results are shown in Table 4.

TABLE 4

| | Wire (mesh) of Filtration Surface | Freeness (°SR) after Treatment | Time (minutes) Required for Compression |
|---|---|---|---|
| Example 10 | 150 | 24.8 | 4.0 |
| Comparative Example 1 | 30 | 36.2 | 16.0 |
| Comparative Example 2 | 80 | 35.9 | 15.5 |
| Comparative Example 3 | 200 | 33.3 | 12.2 |

EXAMPLE 11

According to the process disclosed in Japanese Examined Patent Publication No. 53-32838, corresponding to U.S. Pat. No. 4,075,172, 50 molar parts of terephthaloyl chloride was polymerized with 25 molar parts of p-phenylene diamine and 25 molar parts of 3,4'-diaminodiphenyl ether in N-methyl-2-pyrrolidone to obtain an aromatic polyamide having an inherent viscosity $\eta inh$ of 3.2. Hydrochloric acid formed by the reaction was neutralized with calcium hydroxide, and the reaction mixture liquid was diluted with N-methyl-2-pyrrolidone to obtain a solution having a polymer concentration of 1%. By using this polymer solution and an aqueous solution containing 30% of N-methyl-2-pyrrolidone as the coagulation bath, pulp particles were prepared by means of an apparatus disclosed in Japanese Examined Patent Publication No. 59-47695 (the diameter was 80 mm). The freeness of the obtained pulp particles was 75° SR.

The pulp particles were subjected to the concentration treatment by using the same rotary filter bed as used in Example 1. The freeness of the obtained pulp particles was 28° SR.

The pulp was filtered by using a Nutsche filter, and the pulp was washed with water in an amount 50 times the amount of the pulp. The time required for water washing was 30 minutes. When the filtration was conducted without the treatment by the rotary filter bed and washing with water in an amount 50 times the amount of the pulp was tried, draining was not completed even after 1 hour and therefore, washing was abandoned.

The pulp which had been treated by the rotary filter bed and washed with water was dispersed for 5 minutes by a household mixer under application of a voltage of 60 volts. The freeness of the pulp was increased to 75° SR.

The sieving results of the so-obtained pulp and the pulp just after precipitation are shown in Table 5.

A paper was formed only from the pulp dispersed by the household mixer, and the dried paper had a strength of 6.9 Kg/$mm^2$ and an elongation of 7.9%.

TABLE 5

| | Just after Precipitation | After Water Washing |
|---|---|---|
| smaller than 150 mesh | 3.7% | 3.6% |
| 150 to 80 mesh | 5.5% | 5.6% |
| 80 to 48 mesh | 36.3% | 36.6% |
| 48 to 24 mesh | 29.4% | 29.6% |
| larger than 24 mesh | 25.1% | 24.6% |

EXAMPLE 12

Poly(metaphenylene isophthalamide) was dissolved in N-methyl-2-pyrrolidone to form a solution having a concentration of 12.5%, and the solution was precipitated according to the method disclosed in Japanese Examined Patent Publication No. 59-47695. An aqueous solution containing 30% of N-methyl-2-pyrrolidone was used as the coagulating solution. The Schopper-Riegler freeness of the obtained pulp was 67.5° SR.

The pulp was treated according to the method disclosed in the specification of European Patent Application No. 85103748.1. More specifically, by using a press having a diameter of 250 mm, the pulp was compressed so that the weight ratio of the pulp to water and N-methyl-2-pyrrolidone was ⅓. The pulp cake was taken out and pulverized to an average size of 10 mesh. The pulp was charged in the compressor having a diameter of 250 mm again and compressed so that the weight ratio of the pulp to water and N-methyl-2-pyrrolidone was ½.8. In this state, 10 parts by weight of water was forcibly circulated through the cake comprising 1 parts by weight of the pulp and 2.8 parts by weight of water and N-methyl-2-pyrrolidone to effect water washing.

The pulp was dispersed in water to form a slurry having a concentration of 0.15%, and the slurry was stirred for 5 minutes by a household mixer under application of a voltage of 70 volts. Fibers of poly(metaphenylene isophthalamide) were cut into a uniform size of 6 mm and added to the slurry in an amount of 0.67 part by weight per part by weight of the pulp, and the mixture was similarly stirred for 1 minute by a household mixer under 70 volts. A paper was formed by using a Tappi standard sheet machine (T-205m-58). In the paper, dots formed because of insufficient dispersion were observed at a frequency of 21 per $m^2$ on the average.

The same pulp was treated according to the method of the present invention so that the Schopper-Riegler freeness was reduced to 25.4° SR, and the pulp was similarly treated according to the method disclosed in the specification of European Patent Application No. 85103748.1 and then similarly treated by a household mixer. Then, a paper was formed by a Tappi standard sheet machine. The frequency of dots formed by insufficient dispersion was less than 1 per $m^2$.

We claim:

1. A method for treating synthetic pulp particles, which comprises:

(1) treating a slurry of synthetic pulp particles having a Schopper-Riegler freeness of more than 30° SR by a concentrator provided with a rotary filter bed to lower the freeness to not more than 30° SR, said concentrator comprising as the main member a rotary cylinder having on the peripheral surface thereof a filtering surface formed of a wire and/or a perforated plate and having at least one wire in the interior thereof, and said cylinder is arranged so that the filter bed is inclined from the slurry inlet side toward the slurry outlet side and the filter bed is not immersed in the filtrate, whereby the slurry of the synthetic pulp particles are gradually concentrated while the slurry is moved in the rotary cylinder;

(2) pressing the synthetic pulp particle slurry; water-washing the resulting pressed cake of synthetic pulp particles in the state where the freeness is not more than 30° SR; and dispersing the synthetic pulp particles in water to restore the freeness to more than 30° SR.

2. A method for treating synthetic pulp particles according to claim 1, wherein the synthetic pulp particles are made of a wholly aromatic polyamide.

3. A method for treating synthetic pulp particles according to claim 1, wherein the rotary filter bed is operated at a rotation number of 10 to 100 rpm.

4. A method for treating synthetic pulp particles according to claim 1, wherein the water washing of the synthetic pulp particles is effected by substitution washing in the compressed state.

* * * * *